United States Patent [19]

Comarmond

[11] Patent Number: 4,800,797

[45] Date of Patent: Jan. 31, 1989

[54] HYDRAULIC PERCUSSION DEVICE AND METHOD OF CONTROLLING SAME

[75] Inventor: Jean S. Comarmond, Vourles, France

[73] Assignee: Etablissements Montabert, Saint-Priest, France

[21] Appl. No.: 83,778

[22] Filed: Aug. 7, 1987

[30] Foreign Application Priority Data

Aug. 7, 1986 [FR] France ..... 86 11710

[51] Int. Cl.[4] ..... F01L 25/02; F01B 7/18

[52] U.S. Cl. ..... 91/307; 91/308; 91/321

[58] Field of Search ..... 91/235, 236, 237, 240, 91/241, 277, 278, 307, 308, 317, 318, 321, 417

[56] References Cited

U.S. PATENT DOCUMENTS

| | | | |
|---|---|---|---|
| 3,552,269 | 1/1971 | Arndt | 91/278 X |
| 3,780,621 | 12/1973 | Romell | 91/278 X |
| 4,172,411 | 10/1979 | Matsuda et al. | 91/278 |
| 4,244,274 | 1/1981 | Oguni | 91/321 X |
| 4,413,687 | 11/1983 | Eklöf | 91/278 X |

*Primary Examiner*—Robert E. Garrett
*Assistant Examiner*—Mark A. Williamson
*Attorney, Agent, or Firm*—Herbert Dubno; Andrew Wilford

[57] ABSTRACT

A hydraulic percussion device comprises a housing defining a longitudinal cylinder, a piston longitudinally reciprocal in the cylinder and subdividing same into a front compartment and a rear compartment, and a tool engageable longitudinally with the piston at the front compartment. The compartments are alternately and oppositely hydraulically pressurized to move the piston forward to strike the tool while traveling at an end speed and to move the piston backward away from the tool, the rate of alternation being a frequency parameter and the speed being a force parameter. A controller varies at least one of the parameters by detecting how much the piston rebounds from the tool after striking same and operating the control means in accordance with how much rebound is detected. How much the piston rebounds can be detected by sensing the pressure in one of the compartments immediately after the piston strikes the tool. As rebound increases the pressure in the rear compartment increases relative to a set point or pressure in the front compartment decreases relative to a set point, and vice versa. Rebound can also be detected by sensing the pressure in one of the compartments and at one of the sides of the source and operating the control means in accordance with the differential between these sensed pressures.

17 Claims, 5 Drawing Sheets

HYDRAULIC PERCUSSION DEVICE AND METHOD OF CONTROLLING SAME

FIELD OF THE INVENTION

The present invention relates to a hydraulic percussion device and a method of operating and controlling same. More particularly this invention concerns a scaling, digging, or chipping device with variable stroke, power, and/or frequency.

BACKGROUND OF THE INVENTION

A standard hammer or percussion device such as described in U.S. Pat. No. 4,508,017 and in commonly assigned copending patent application No. 886,546 of J. C. Bartomeuf has a housing forming a cylinder in which is provided a piston that is longitudinally reciprocal and that defines in the cylinder an upper or rear compartment and a lower or front compartment separated longitudinally therefrom by the piston. This piston moves forward, that is longitudinally toward the front compartment, to strike the rear end of a tool used to dig, chip or the like, and backward to return to a starting position spaced longitudinally behind the tool. The force for forward motion, which is normally downward, comes from the pressure differential between the front and rear compartments while the force for backward or return motion comes in part from this differential and in part from the piston rebounding from the tool.

Efficiency, chiefly penetration, is maximized when working on a hard workpiece by using blows of a relatively low frequency but of considerable energy while with a soft workpiece light blows of high frequency are used. The energy imparted to the tool by the piston at the forward end of its stroke is directly related to the piston speed at this instant. This speed can be increased by increasing the pressure differential moving the piston to increase its acceleration or by increasing the length of the piston's stroke to give it more time to get up to the speed and this speed can be decreased by oppositely varying these parameters. The frequency is controlled mainly by a reversible distributing valve connected on the one side to high- and low-pressure sides of a source of fluid and on the other side of the front and rear compartments longitudinally flanking the piston as well in stroke-adjustable models to ports defining the front end of the rear compartment or rear end of the front compartment.

Thus it is not impossible for such a device to have independent adjustment knobs, levers, or the like for force and frequency. Readjustment is necessary when the workpiece changes so that it is necessary to trade off time wasted adjusting the tool on one hand against effectiveness of the tool on the other.

OBJECTS OF THE INVENTION

It is therefore an object of the present invention to provide an improved percussion device and method of operating same.

Another object is the provision of such a percussion device and method of operating same which overcomes the above-given disadvantages, that is which automatically detects the workpiece type and adjusts the speed and/or frequency to maximize operating efficiency.

SUMMARY OF THE INVENTION

This invention relates to the control of a hydraulic percussion device comprising a housing defining a longitudinal cylinder, a piston longitudinally reciprocal in the cylinder and subdividing same into a front compartment and a rear compartment, and a tool engageable longitudinal with the piston at the front compartment. The compartments are alternately and oppositely hydraulically pressurized to move the piston forward to strike the tool while traveling at an end speed and to move the piston backward away from the tool, the rate of alternation being a frequency parameter and the speed being a force parameter. According to the invention a controller varies at least one of the parameters by detecting how much the piston rebounds from the tool after striking same and operating the control means in accordance with how much rebound is detected.

The invention is based on the discovery that how much the piston rebounds is a function of the hardness of the workpiece. When the workpiece is hard the tool and piston rebound greatly, and when soft they only rebound a little. Once the extent of rebound is determined, the device automatically regulates the pressure differential, piston-stroke length, and/or frequency to maximize the efficiency of the tool.

According to this invention how much the piston rebounds is detected by sensing the pressure in one of the compartments immediately after the piston strikes the tool. As rebound increases the pressure in the rear compartment increases relative to a set point or pressure in the front compartment decreases relative to a set point, and vice versa.

According to another feature of this invention how much the piston rebounds is detected by sensing the pressure in one of the compartments and at one of the sides of the source and operating the control means in accordance with the differential between these sensed pressures. Thus the controller can increase the pressure differential across the piston when moving forward when the differential immediately after it strikes the tool increases and vice versa. It can also increase the length of the effective stroke of the piston when moving forward when the differential immediately after it strikes the tool increases and vice versa.

DESCRIPTION OF THE DRAWING

The above and other objects, features, and advantages will become more apparent from the following, reference being made to the accompanying drawing in which.

SPECIFIC DESCRIPTION

Figure 1:
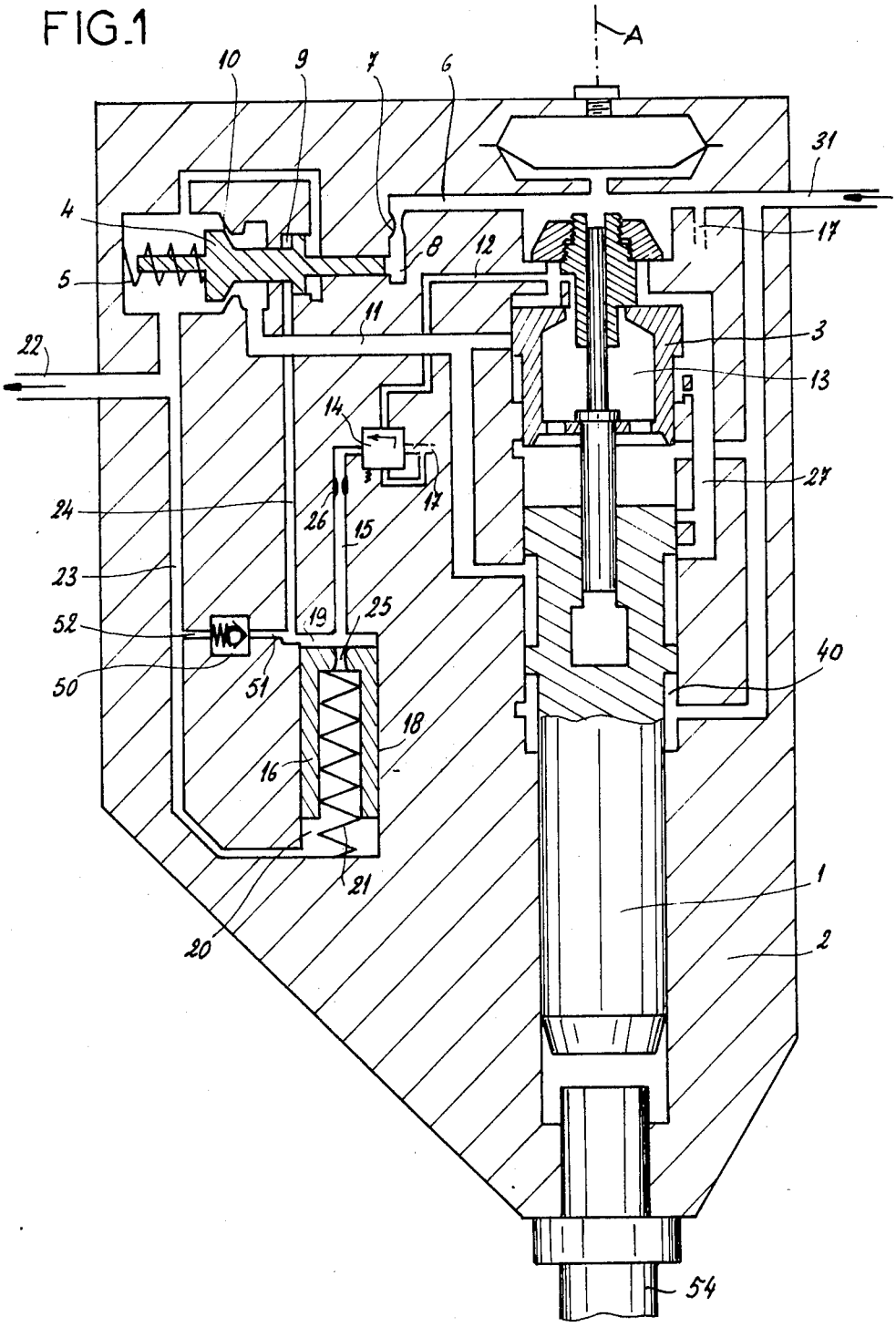
FIG. 1 is a partly diagrammatic axial section through a percussion tool according to this invention of the variable-pressure type.

As seen in FIG. 1 and as described in more detail in the above-cited patent, patent application, and references cited therein (to which reference should be made for further details) a percussion device basically comprises a housing 2 formed with a cylinder extending along an axis A and subdivided by a piston 1 carrying a distributor 3 into a lower or front compartment 40 and an upper or rear compartment 13. A tool 54 normally limitedly movable along the longitudinal axis A is engageable in the front compartment 40 with the piston 1. The housing 2 is connected at 31 to the high-pressure side of a source of hydraulic liquid and at 22 to the sump or the low-pressure side of this source. A side passage 27 extends between the rear compartment 13 and an intermediate region on the piston 1 for reversing the device as described in the above-cited patent documents.

In this arrangement the front compartment 40 is of relatively small effective surface area on the piston 1 and is continuously connected to the high-pressure line 31. A distributing-valve body 4 has a small-area end exposed in a chamber 8 via a restriction 7 to the high pressure of the line 31, an opposite large-area end exposed to the sump line 22, and an intermediate region connected via a line 11 to the rear compartment 13. This valve body 4 forms a restriction 10 between the sump 22 and line 11 and is urged in a direction tending to close this restriction 10 by a spring 5 which acts opposite to the pressure at the opposite end chamber 8. In addition the body 4 defines a small chamber 9 effective on this body 4 opposite to the pressure of the chamber 8 and connected via a pilot line 24 to a buffer chamber 19 defined in part by a piston 16 movable in a cylinder bore 18 and urged in one direction by a spring 21. This chamber 19 is connected via a restriction 25 to a chamber 20 itself connected to the sump 22 and via a line 15 having a restriction 26 to a threshold or sequencing valve 14. This valve 14 itself is connected at one side via a pilot duct 17 to the high-pressure intake line 31 and via another duct 12 to the rear compartment 13. The chamber 19 is also connected via an overpressure valve 50 and lines 51 and 52 to the sump 22.

The valve 14 compares the pressure in the rear compartment 13 with the high-pressure input liquid at 31. It permits liquid to flow through the line 15 when the pressure in the rear compartment 13 is greater than the feed pressure of the apparatus. The buffer valve body 16 moves to compensate for modest temporary pressure fluctuations. The buffer-valve body 16 is in equilibrium when flow into the chamber 19 through the restriction 26 is equal to the flow out through the restriction 25.

So long as the device is working in soft ground or the like, the piston 1 rebounds very little or not at all. Thus the pressure in the rear compartment 13 immediately after the piston 1 strikes the tool 54 does not substantially exceed the pressure in the input line 31. As a result the sequencing valve 14 does not permit any liquid to flow through in the passage 15. This keeps the pressure in the chamber 19 and in the chamber 9 low. As a result the restriction 10 stays mainly open, keeping the working pressure and piston speed low.

If on the contrary the workpiece being engaged by the tool 54 is hard, the piston 1 rebounds considerably. The pressure in the compartment 13 therefore peaks right after impact so as to exceed the pressure in the input line 31 and the valve 14 opens, feeding pressure through the line 15, chamber 19, and line 24 to the chamber 9. The valve body 4 closes the restriction 10 so as to increase the operating pressure of the system as well as the maximum piston speed.

Figure 2:
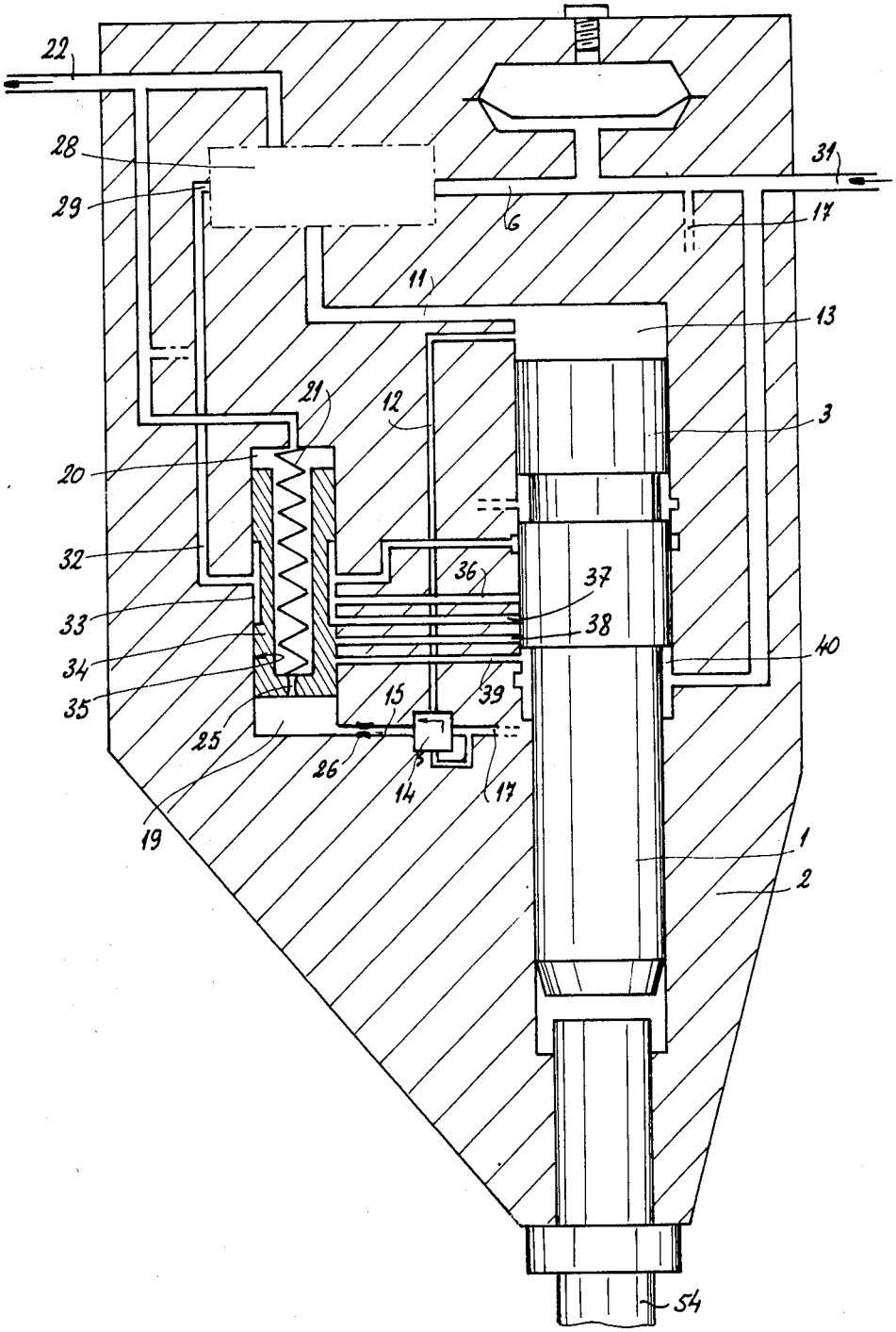
FIGS. 2, 3, and 4 are partly diagrammatic axial sections through percussion tools according to this invention of the variable-stroke type.

In the arrangement of FIG. 2, where references identical to those of FIG. 1 are used for identical structure. the reversal of the pressure differential between the compartments 13 and 40 that reciprocates the piston 1 is effected by a standard distributor valve 28. The pressure in a pilot passage 29 of this valve 28 determines whether the rear compartment 13 is connected to the high-pressure side 31 or the low-pressure side 22. The slide 34 is normally balanced in the chamber 19 since the pressure that passes each time the piston 1 reciprocates can move out through the restriction 25.

This pilot passage 29 is fed liquid from a passage 32 opening into an annular groove 33 of a slide 34 movable in a cylinder 35. Depending on its position, the groove 33 can let the line 32 communicate with one or all of a group of passages 36, 37, 38, and 39 which open into the front end of the cylinder adjacent the compartment 40, and which can in fact open into this compartment 40 in successive positions of the piston 1. Thus the stroke of the piston 1 depends on which of the passages 36 through 39 is uncovered by the groove 33 and, therefore, in communication with the passages 32 and 29. When the stroke is longer, the piston 1 gains more speed and, therefore, strikes the tool with greater force and vice versa.

The sequencing valve 14 here is connected just like that of FIG. 1 so that if the workpiece being engaged by the tool 54 is hard, the piston 1 rebounds considerably. The pressure in the compartment 13 therefore peaks right after impact to exceed the pressure in the input line 31 and the valve 14 opens, feeding pressure through the line 15, to the chamber 19. The slide 34 moves up against the force of its spring 21 to cover more of the passages 37–39, thereby increasing stroke length and piston speed.

When the device is working in soft ground or the like, the piston 1 rebounds very little or not at all. Thus the pressure in the rear compartment 13 immediately after the piston 1 strikes the tool 54 does not substantially exceed the pressure in the input line 31. As a result the sequencing valve 14 does not permit any liquid to flow through the passage 15. This keeps the pressure in the chamber 19 low. As a result the passages 36–39 stay uncovered and the stroke of the piston 1 is short.

Figure 3:
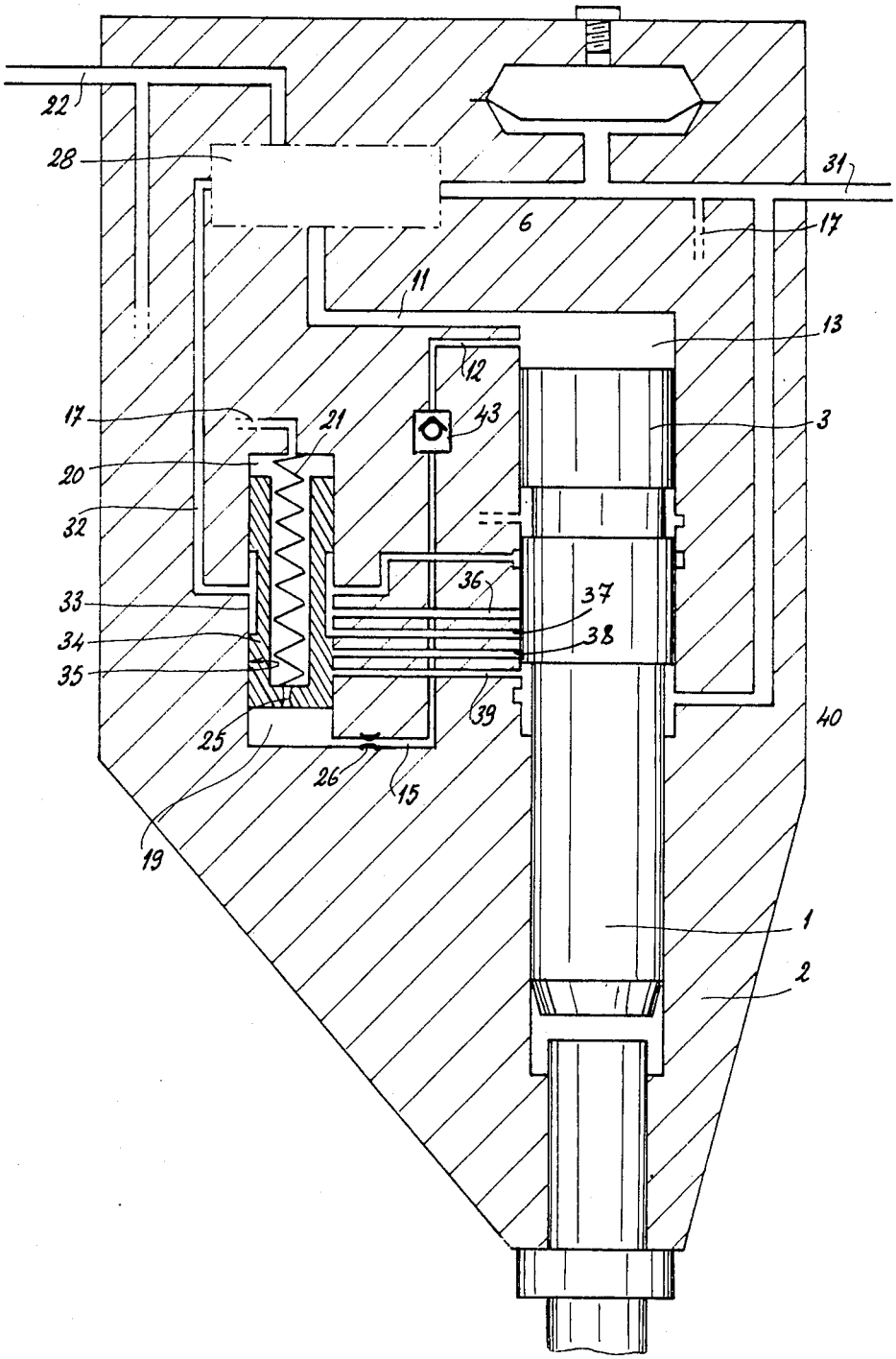

In FIG. 3 everything is identical to FIG. 2, except that the valve 14 is replaced by a check valve 43 connected between the lines 15 and 12 so that liquid can only flow from the compartment 13 to the chamber 19. In addition the chamber 20 on the other side of the slide 34 from the chamber 19 communicates by the passage 17 with the high-pressure source line 31. Thus when the pressure in the compartment 13 is greater than that of the feed line 31 a certain amount of fluid can flow through the passage 12, the check valve 43, and the passage 15 into the buffer chamber 19. This check valve 43 prevents flow of liquid from the chamber 19 to the compartment 13 when same is connected by the distributor valve 28 to the low-pressure line 22 during the return stroke of the piston 1.

When the ground is hard, the pressure in compartment 13 goes to the chamber 19 to push the slide 34 back and cover up more of the passages 36–39, thereby lengthening the piston stroke. Similarly in soft ground the slide 34 moves forward to uncover more of the grooves 33 and thereby shorten the stroke.

Figures 4, 5:
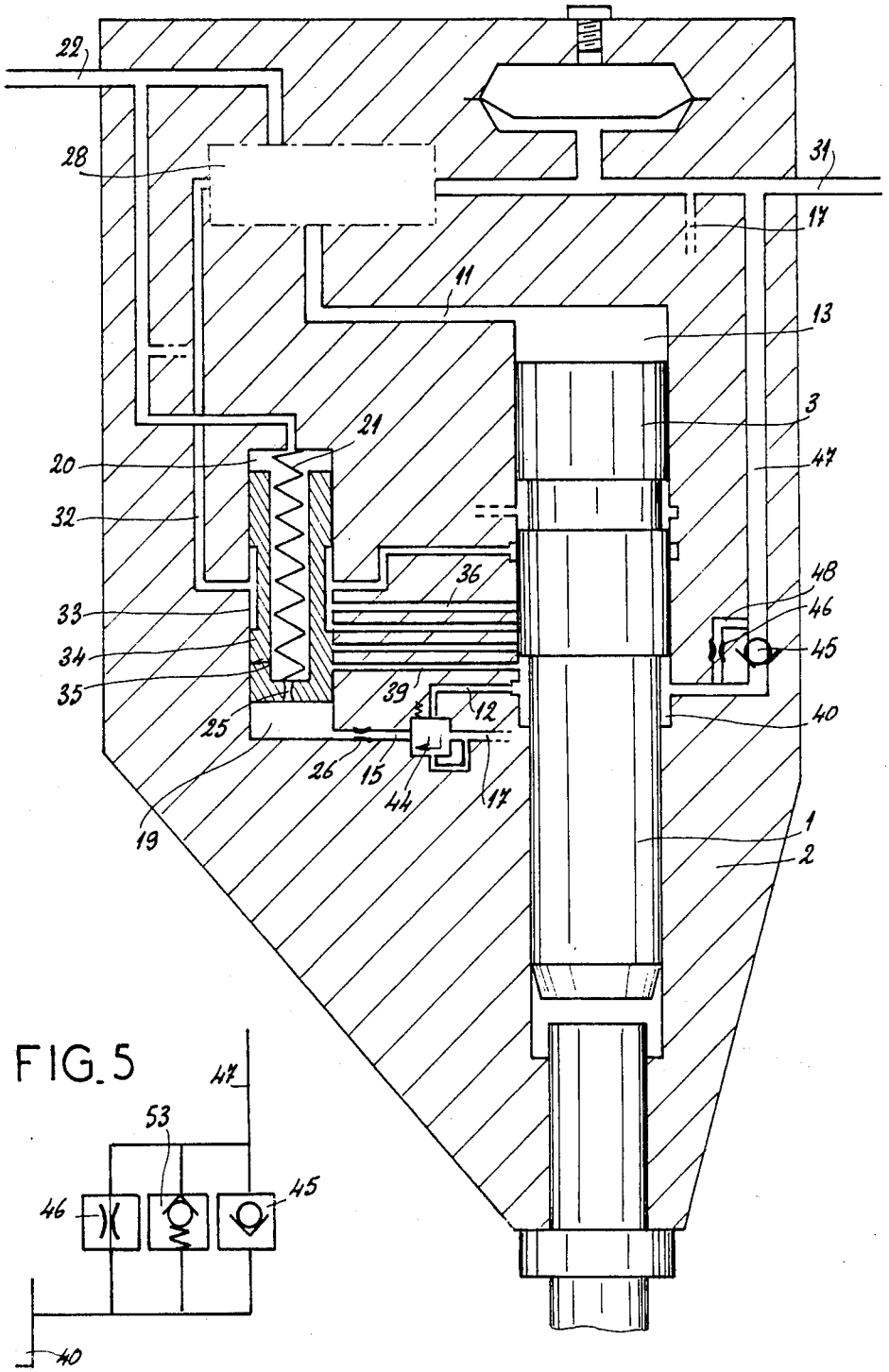
FIG. 5 is a large-scale view of a detail of a variant on the system of FIG. 4.

FIG. 4 shows another system wherein the stroke of the piston is automatically adjusted according to workpiece hardness, as in FIGS. 2 and 3. Here the passage 12 opens not into the upper compartment 13 but into the lower compartment 40. A sequencing valve 44 in this passage 12 permits liquid flow from the source via the line 17 to the buffer chamber 19 when the pressure in the compartment 40 is less than the high feed pressure. To this end the device has a passage 47 feeding the high pressure to the compartment 40 and provided with a check valve 45 permitting free flow back through this line 47 to the source 31. A small bypass 48 around the valve 45 has a restriction so that enough pressure is fed to the front compartment 40 to return the piston 1 at the end of each stroke.

In this arrangement the slide 34 is balanced when the pressure in the chamber 19 is equalized by identical inflow via the line 15 and outflow through the restriction 25, the inflow being pulsed from the sequencing valve. If the hardness of the workpiece increases with this system the speed and length of the rebound of the piston will similarly increase. During such rebound the flow passing through the restriction 46 is smaller than the flow necessary to increase the volume of the compartment 40 so that its pressure drops. When the pressure in the compartment 40 is less than the feed pressure, the sequencing valve 44 injects liquid into the buffer chamber 19 so as to increase the pressure in same and push the slide 34 against the spring 21, thereby covering more of the passages 36–39 and increasing the length of the piston stroke. If the workpiece becomes softer there is less rebound and liquid entering the chamber 19 so that the slide 34 shortens the piston stroke.

In order to eliminate cavitation in the compartment 40 on rebound of the piston 1 from the tool 54 FIG. 5 shows how another spring-loaded check valve 54 opposite to the valve 45 can be used to bypass this valve 45. Thus a substantial drop in pressure in the compartment 40 will cause some flow through this valve 53 to fill the compartment 40.

Figure 6:
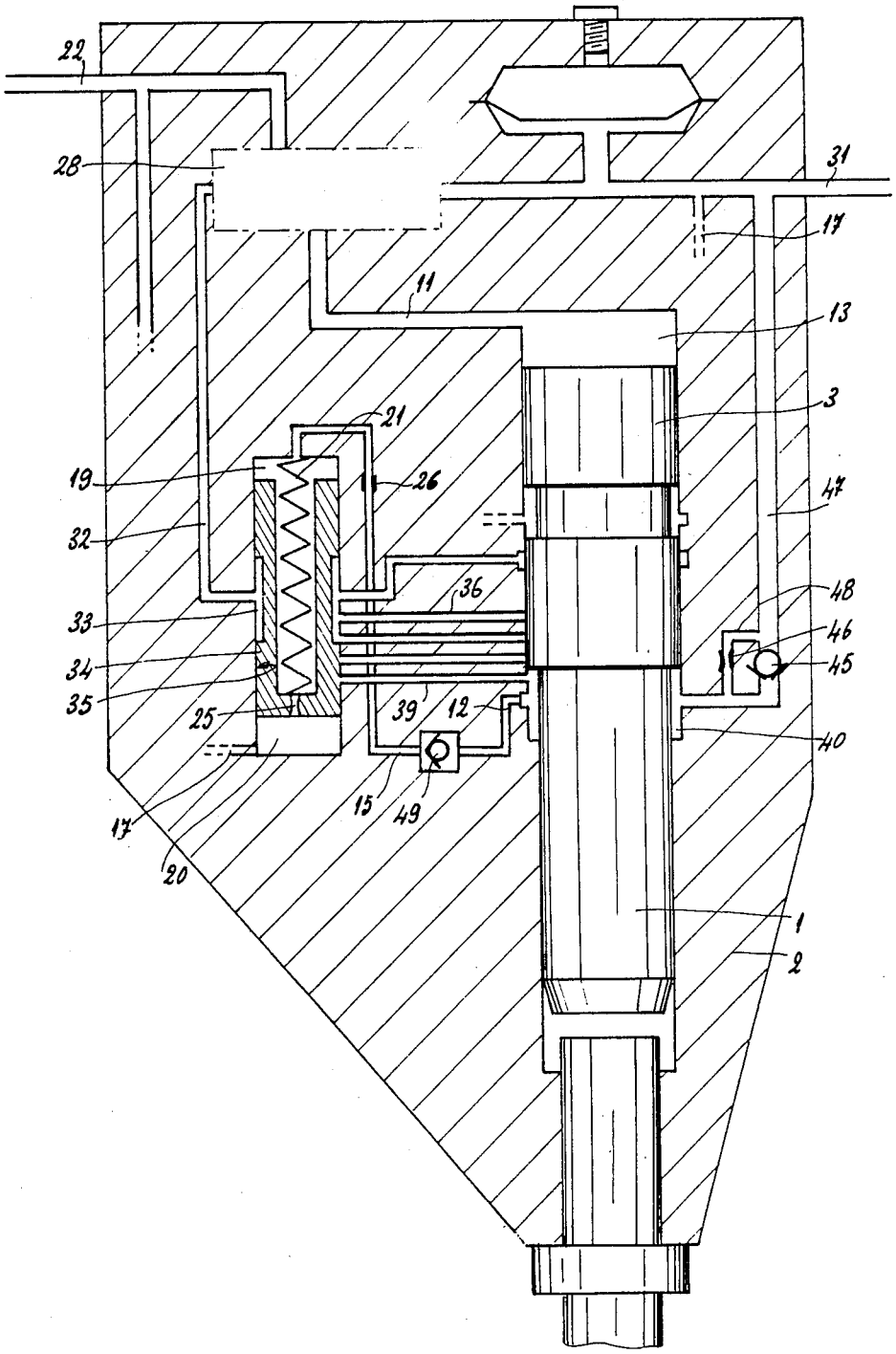
FIG. 6 is another partly diagrammatic axial section through a variable-stroke percussion device in accordance with this invention.

The system of FIG. 6 is a combination of the systems of FIG. 4 and 3. More specifically the passage 12 opens as in FIG. 4 into the lower compartment 40 and is provided with a check valve 49 preventing flow from the compartment 40 toward the chamber 20 which is itself connected to the high-pressure feed passage 17. The slide 34 is balanced between the pressure in the buffer chamber 19 with the flow from the chamber 20 through the restriction 25 is equal to the pulsed flow out through the line 12 and restriction 26.

The harder the workpiece, the longer will be the time during which the pressure inside the lower compartment 40 is below the pressure of the buffer chamber 19 and the greater is the quantity of liquid bleeding out of the buffer chamber 19 so that the slide 34 is moved against the spring 21 and the passages 36 through 39 are selected to increase the length of the stroke of the piston.

Thus with the system of the present invention the device automatically adjusts for maximum efficiency in accordance with workpiece hardness. Even if the workpiece hardness changes while operating, the machine will adjust. Thus there is no time wasted adjusting the machine and maximum efficiency is assured at all times.

I claim:

1. A method of operating a hydraulic percussion device comprising:

a housing defining a longitudinal cylinder;

a piston longitudinally reciprocal in the cylinder and subdividing same into a front compartment and a rear compartment;

a tool engageable longitudinally with the piston at the front compartment;

means for alternately and oppositely hydraulically pressurizing the compartments from a source having a high-pressure side and a low-pressure side to move the piston forward to strike the tool while traveling at an end speed and to move the piston backward away from the tool, the rate of alternation being a frequency parameter and the speed being a force parameter; and control means for varying at least one of the parameters; the method comprising the steps of:

detecting how much the piston rebounds from the tool after striking same by sensing the pressure in one of the compartments immediately after the piston strikes the tool; and operating the control means in accordance with how much rebound is detected.

2. The method defined in claim 1 wherein how much the piston rebounds is detected by sensing the pressure in one of the compartments and at one of the sides and operating the control means in accordance with the differential between these sensed pressures.

3. The method defined in claim 2 wherein the control means increases the pressure differential across the piston when moving forward when the pressure differential between the one compartment and the one side immediately after it strikes the tool increases and vice versa.

4. The method defined in claim 2 wherein the control means increases the length of the effective stroke of the piston when moving forward when the pressure differential between the one compartment and the one side immediately after it strikes the tool increases and vice versa.

5. A hydraulic percussion device powered by a hydraulic source having a high-pressure side and a low-pressure side, the device comprising:

a housing defining longitudinal main cylinder;

a piston longitudinally reciprocal in the main cylinder and subdividing same into a front compartment and a rear compartment;

a tool engageable longitudinally with the piston at the front compartment;

means for alternately and oppositely hydraulically pressurizing the compartments to move the piston forward to strike the tool while traveling at an end speed and to move the piston backward away from the tool, the rate of alternation being a frequency parameter and the speed being a force parameter;

control means for varying at least one of the parameters;

means for detecting how much the piston rebounds from the tool after striking same including means for sensing the pressure in one of the compartments immediately after the piston strikes the tool; and means for operating the control means in accordance with how much rebound is detected.

6. A hydraulic percussion device powered by a hydraulic source having a high-pressure side and a low-pressure side, the device comprising:

a housing defining a longitudinal main cylinder;

a piston longitudinally reciprocal in the main cylinder and subdividing same into a front compartment and a rear compartment;

a tool engageable longitudinally with the piston at the front compartment;

means for alternately and oppositely hydraulically pressurizing the compartments to move the piston forward to strike the tool while traveling at an end speed and to move the piston backward away from the tool, the rate of alternation being a frequency parameter and the speed being a force parameter;

control means for varying at least one of the parameters;

means for detecting how much the piston rebounds from the tool after striking same;

means for operating the control means in accordance with how much rebound is detected, said control means including:

a control valve connected to both sides of the source and to the rear compartment; and a buffer valve connected between the control valve and the front compartment, the detecting means including a detecting valve connected to the source and to the buffer valve.

7. The device defined in claim 6 wherein the detecting valve is a sequencing valve connected between the rear compartment, the high-pressure side, and the buffer valve.

8. The device defined in claim 6 wherein the detecting valve is a sequencing valve connected between the front compartment, the high-pressure side, and the buffer valve.

9. The device defined in claim 6 wherein the detecting valve is a check valve connected between the rear compartment and the buffer valve.

10. The device defined in claim 6 wherein the buffer valve has:

a cylinder, a slide subdividing this buffer-valve cylinder into a a chamber connected to the detecting valve and a chamber connected to one side of the source, a restriction through which flow between the chambers is possible, a spring urging the slide to decrease the volume of one of the chambers and increase the volume of the other chamber.

11. The device defined in claim 10 wherein the one side is the low-pressure side and the one chamber is the chamber connected to the detecting valve, the detecting valve being a pressure-threshold valve connected between the high-pressure side of the source and the rear compartment and operable to connect the detecting-valve chamber of the buffer valve to the high-pressure side when the pressure in the rear compartment exceeds the pressure of the high-pressure side, the high-pressure side being directly connected to the front compartment.

12. The device defined in claim 10 wherein the slide is formed with an outwardly open groove, the control valve being connected via a passage continuously to this groove, the device further having a plurality of ducts opening into the main cylinder at spaced locations and into the buffer-valve cylinder at corresponding spaced locations, the groove successively exposing the ducts on expansion of the other compartment.

13. The device defined in claim 12 wherein the one side is the low-pressure side and the detecting valve is connected between the rear compartment and the high-pressure side and is operable to open when the pressure in the rear compartment exceeds that at the high-pressure side.

14. The device defined in claim 12 wherein the one side is the high-pressure side and the detecting valve is connected to the front compartment.

15. A hydraulic percussion device powered by a hydraulic source having a high-pressure side and a low-pressure side, the device comprising:

a housing defining a longitudinal main cylinder;

a piston longitudinally reciprocal in the main cylinder and subdividing same into a front compartment and a rear compartment;

a tool engageable longitudinally with the piston at the front compartment;

means for alternately and oppositely hydraulically pressurizing the compartments to move the piston forward to strike the tool while traveling at an end speed and to move the piston backward away from the tool, the rate of alternation being a frequency parameter and the speed being a force parameter;

control means for varying at least one of the parameters;

means for detecting how much the piston rebounds from the tool after striking same including means for sensing the pressure in one of the compartments and at one of the sides and operating the control means in accordance with the differential between these sensed pressures; and means for operating the control means in accordance with how much rebound is detected.

16. The device defined in claim 15 wherein the control means increases the pressure differential across the piston when moving forward when the pressure differential between the one compartment and the one side immediately after it strikes the tool increases and vice versa.

17. The device defined in claim 15 wherein the control means increases the length of the effective stroke of the piston when moving forward when the pressure differential between the one compartment and the one side immediately after it strikes the tool increases and vice versa.

* * * * *